US007708487B2

(12) United States Patent
Leibman

(10) Patent No.: US 7,708,487 B2
(45) Date of Patent: May 4, 2010

(54) BINDER SPINE

(76) Inventor: Ellis H. Leibman, 3804 Hollyline Ave., Sherman Oaks, CA (US) 91423

( * ) Notice: Subject to any disclaimer, the term of this patent is extended or adjusted under 35 U.S.C. 154(b) by 732 days.

(21) Appl. No.: 10/824,841

(22) Filed: Apr. 15, 2004

(65) Prior Publication Data

US 2004/0213630 A1 Oct. 28, 2004

Related U.S. Application Data

(63) Continuation-in-part of application No. 29/170,604, filed on Nov. 7, 2002, now abandoned.

(51) Int. Cl.
*B42F 13/30* (2006.01)
*B42F 13/36* (2006.01)

(52) U.S. Cl. ..... 402/46; 402/68

(58) Field of Classification Search ..... 402/8, 402/64, 80 P, 5, 14, 46, 54, 55, 68, 70, 80 R, 402/500, 502; 281/21.1
See application file for complete search history.

(56) References Cited

U.S. PATENT DOCUMENTS

| | | | | | |
|---|---|---|---|---|---|
| 847,389 | A | | 3/1907 | Wilson | |
| 1,670,396 | A | * | 5/1928 | Wood | 281/19.1 |
| 1,900,601 | A | * | 3/1933 | Felder | 402/61 |
| 3,087,498 | A | * | 4/1963 | Vogel | 402/22 |
| 3,260,264 | A | | 7/1966 | McKowen | |
| 3,574,472 | A | | 4/1971 | Cott | |
| 3,612,709 | A | * | 10/1971 | Miyamoto | 402/2 |
| 3,757,389 | A | * | 9/1973 | Wiland | 24/708.6 |
| 4,307,972 | A | | 12/1981 | Errichiello | |
| 4,340,316 | A | | 7/1982 | Jahn | |
| 5,018,895 | A | * | 5/1991 | Meier, Jr. | 402/4 |
| 5,163,768 | A | * | 11/1992 | Salisbury et al. | 402/3 |
| D338,040 | S | * | 8/1993 | Hutchinson | D19/65 |
| D360,221 | S | | 7/1995 | Wu | |
| 5,667,092 | A | * | 9/1997 | Julius et al. | 220/259.1 |
| 5,865,469 | A | | 2/1999 | Chin | |
| 6,076,990 | A | | 6/2000 | Jahn | |
| 6,099,187 | A | * | 8/2000 | Youngs | 402/60 |
| D480,105 | S | * | 9/2003 | Leibman | D19/32 |
| 6,663,310 | B2 | * | 12/2003 | Han | 402/8 |

* cited by examiner

*Primary Examiner*—Dana Ross
*Assistant Examiner*—Pradeep C Battula
(74) *Attorney, Agent, or Firm*—Bruce A. Jagger

(57) ABSTRACT

A binder spine with a generally rectangular back panel that has a width and a length. The back panel is bounded by generally opposed longitudinal edges. The opposed longitudinal edges are joined through living hinges to adjacent side panels. The binder spine is foldable along the living hinges between an open generally flat configuration and a generally closed configuration. At least one post member is located on one of the side panels, and at least one socket member is located on the other side panel. The socket and post members are aligned with one another and include generally cylindrical mating walls. The post and socket members are spaced apart in the open configuration by a distance. The socket and post members are positioned to retainingly interengage one another in the closed configuration to hold the binder spine in that closed configuration. The socket in the socket member receives the post member in a snap fit. When a system including several of these binder spines with different capacities is provided the dimensions and proportions remain substantially the same except for the post members and the width of the back panel.

9 Claims, 3 Drawing Sheets

*Fig. 1*
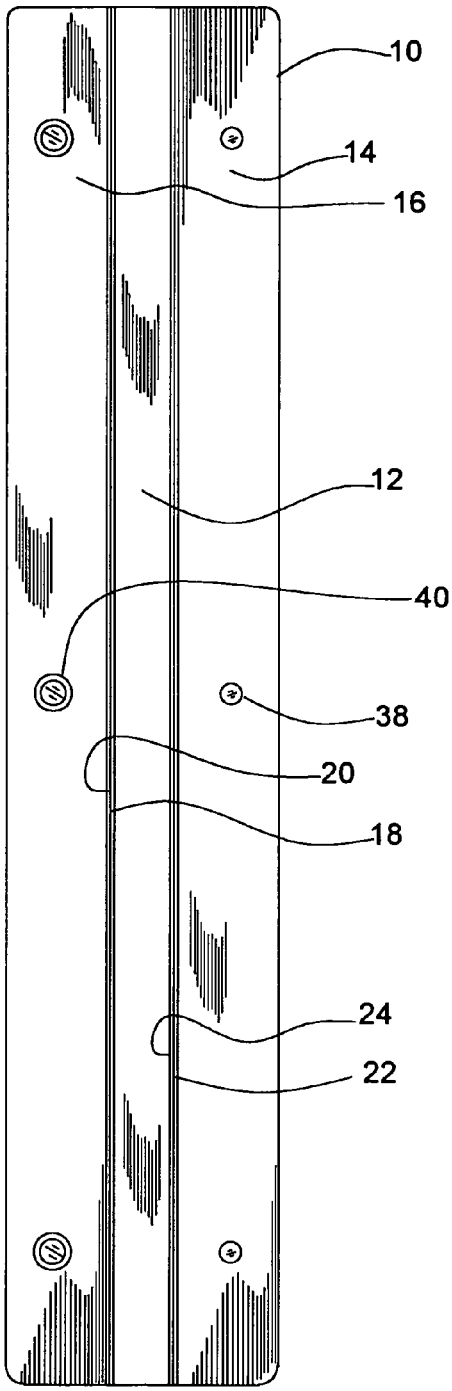
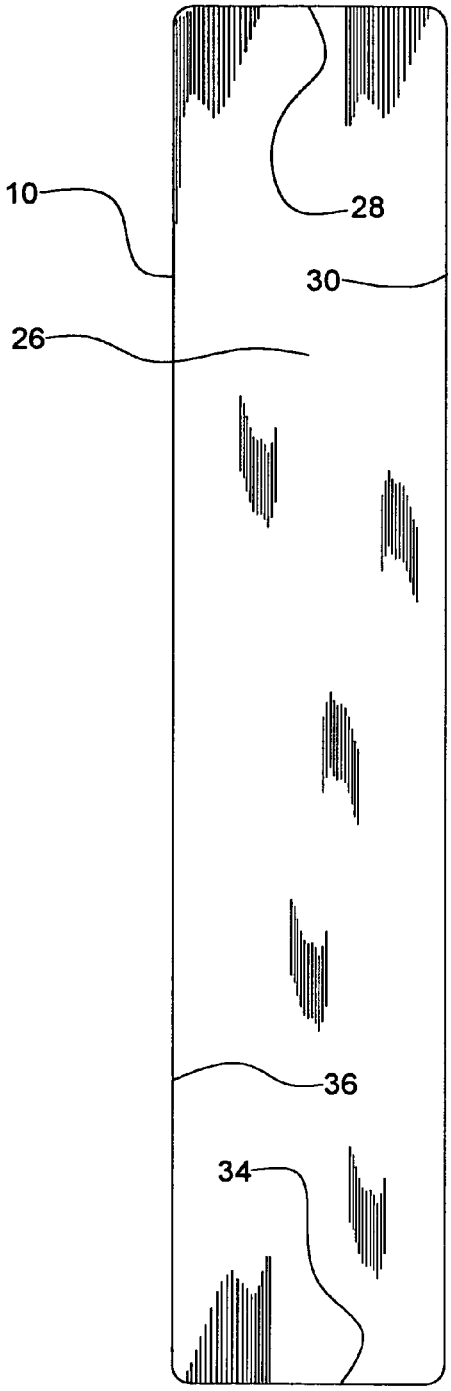
*Fig. 2*

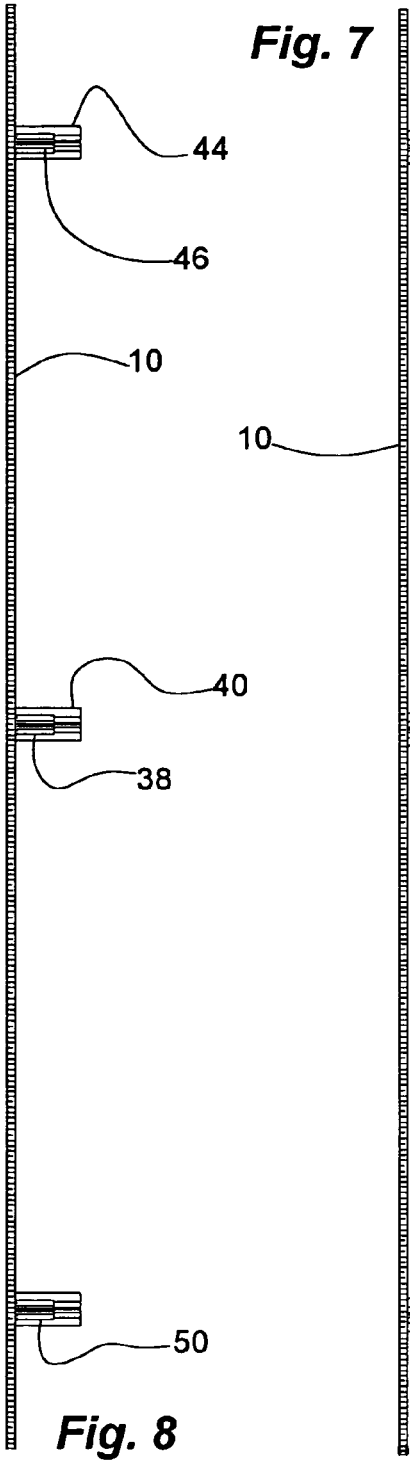
Fig. 7
Fig. 8
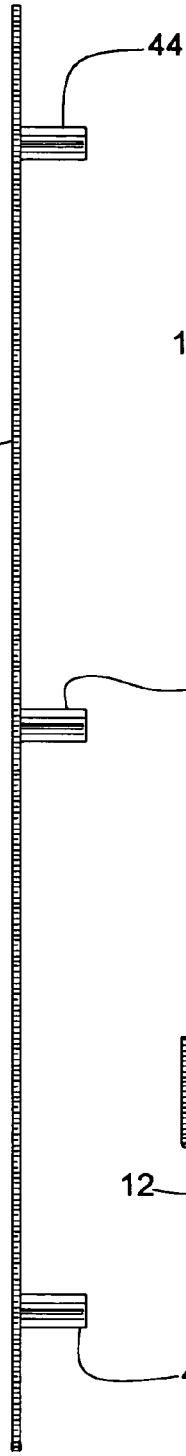
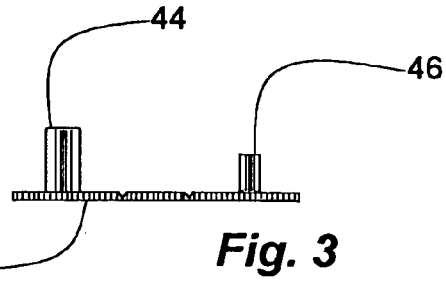
Fig. 3
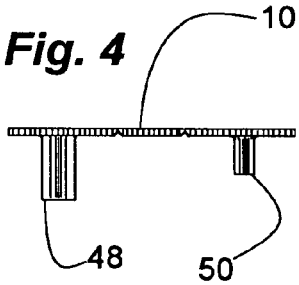
Fig. 4
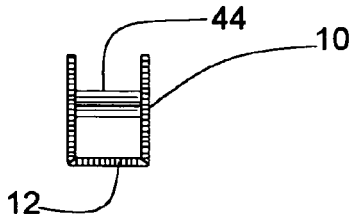
Fig. 5
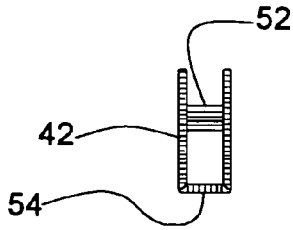
Fig. 6

Fig. 9
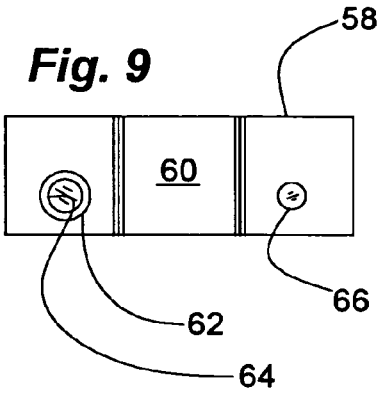
Fig. 10
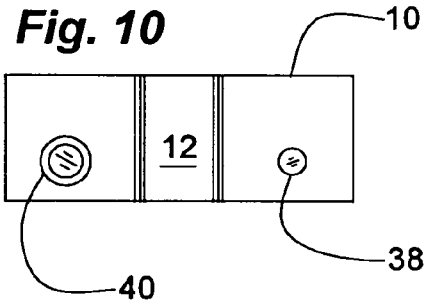
Fig. 11
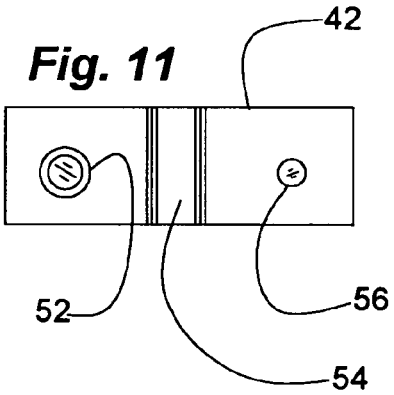
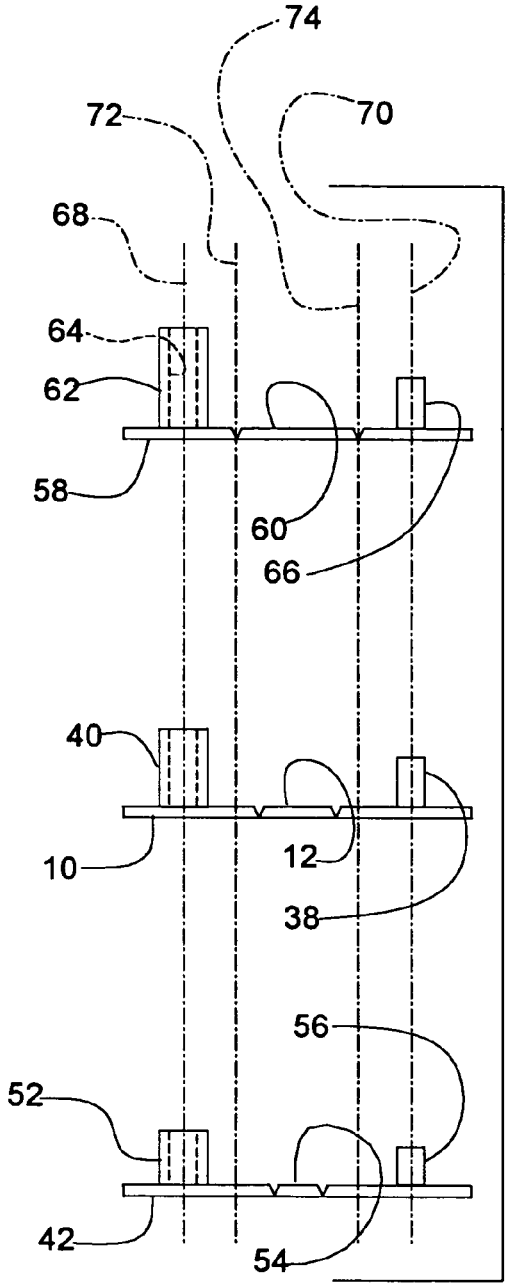
Fig. 12

BINDER SPINE

RELATED APPLICATIONS

This is a continuation-in-part of U.S. application Ser. No. 29/170,604, filed Nov. 7, 2002 now abandoned.

BACKGROUND OF THE INVENTION

1. Field of the Invention

The invention relates in general to binder spines, and, more systems of binder spines.

2. Description of the Prior Art

Binder spines have been proposed for holding loose papers together. The prior proposed expedients are not without their shortcomings. Major shortcomings of typical prior binder spines include, for example, complexity, cost, and difficulty of use. Previous expedients did not generally include the provision of a system of binders that provide increased utility to the user yet permit the manufacturer to readily supply a system including a plurality of binder spines with different capacities.

Previously proposed expedients include, for example, Wu US Des. 360,221, Exline U.S. Pat. No. 0,847,389 (check book binder with spring loaded engagement of securing posts with deformed tubes), McKowen U.S. Pat. No. 3,260,264 (a binding for books composed of a molded one-piece binding unit with living hinges, binding posts, and a port in which a mushroom head of the binding post engages), Cott U.S. Pat. No. 3,574,472 (a molded one-piece binder for perforated loose leaf sheets wherein a headed post is inserted into an open sided groove to hold the binder in a closed configuration), Errichiello U.S. Pat. No. 4,307,972 (a molded one-piece loose leaf book with plastic posts wherein a headed post frictionally engages a tubular post), Jahn U.S. Pat. No. 4,340,316 (a binder in which a barb headed post engages an open sided slot), Chin U.S. Pat. No. 5,865,469 (a binding bar for a cover folder in which the edges of the binder bar engage barbs in the cover), and Jahn U.S. Pat. No. 6,076,990 (a one-piece binder wherein a barb headed post engages and open sided slot).

Those concerned with these problems recognize the need for an improved binder spine.

BRIEF SUMMARY OF THE INVENTION

The present invention has been developed in response to the current state of the art, and in particular, in response to these and other problems and needs that have not been fully or completely solved by currently available binder spines. Thus, it is an overall object of the present invention to effectively resolve at least the problems and shortcomings identified herein. In particular, it is an object of the present invention to provide binder spines wherein engagement between generally straight sided cylindrical post and socket walls provides a "snap fit". It is also an object of the present invention to provide a system of binder spines wherein the individual members of the system have different capacities but similar dimensions and proportions.

A preferred embodiment of the binder spine according to the present invention comprises a post member that is engageable with a socket in a socket member through a snap fit. Further, a system of such binder spines according to the present invention includes spines with different capacities but substantially identical dimensions and proportions except for the width of a back panel and the lengths of the binder post members.

To acquaint persons skilled in the pertinent arts most closely related to the present invention, preferred embodiments of a binder spine and a system of binder spines that illustrates a best mode now contemplated for putting the invention into practice is described herein by, and with reference to, the annexed drawings that form a part of the specification. The exemplary embodiments are described in detail without attempting to show all of the various forms and modifications in which the invention might be embodied. As such, the embodiments shown and described herein are illustrative, and as will become apparent to those skilled in the arts, can be modified in numerous ways within the scope and spirit of the invention, the invention being measured by the appended claims and not by the details of the specification or drawings.

Other objects, advantages, and novel features of the present invention will become more fully apparent from the following detailed description of the invention when considered in conjunction with the accompanying drawings, or may be learned by the practice of the invention as set forth herein.

BRIEF DESCRIPTION OF THE DRAWINGS

The present invention provides its benefits across a broad spectrum of binder spines. While the description which follows hereinafter is meant to be representative of a number of such applications, it is not exhaustive. As those skilled in the art will recognize, the basic apparatus taught herein can be readily adapted to many uses. This specification and the claims appended hereto should be accorded a breadth in keeping with the scope and spirit of the invention being disclosed despite what might appear to be limiting language imposed by the requirements of referring to the specific examples disclosed.

Referring particularly to the drawings for the purposes of illustrating the invention and its presently understood best mode only and not limitation:

FIG. 1 is a top plan view of a paper binder spine of the present invention in the unfolded configuration.

FIG. 2 is a bottom plan view of the embodiment of FIG. 1.

FIG. 3 is a right end elevation of the embodiment of FIG. 1.

FIG. 4 is a left end elevation of the embodiment of FIG. 1.

FIG. 5 is a right end elevation of the embodiment of FIG. 1 showing the embodiment in the folded configuration.

FIG. 6 is a right end elevation similar to FIG. 5 showing an additional embodiment in the folded configuration.

FIG. 7 is a front elevation of the embodiment of FIG. 1 showing the embodiment in the unfolded configuration.

FIG. 8 is a rear elevation of the embodiment of FIG. 1 showing the embodiment in the unfolded configuration.

FIG. 9 is a plan view of a section of an additional embodiment.

FIG. 10 is a plan view of a section of the embodiment of FIG. 1.

FIG. 11 is a plan view of a section of an additional embodiment.

FIG. 12 is a cross-sectional view of the embodiments of FIGS. 9 through 11 showing the alignment and proportioning of the members of a system of binder spines of different capacities.

DETAILED DESCRIPTION OF THE PREFERRED EMBODIMENTS

Referring now to the drawings wherein like reference numerals designate identical or corresponding parts throughout the several views. It is to be understood that the drawings are diagrammatic and schematic representations of various embodiments of the invention, and are not to be construed as limiting the invention in any way. The use of words and phrases herein with reference to specific embodiments is not intended to limit the meanings of such words and phrases to those specific embodiments. Words and phrases herein are intended to have their ordinary meanings, unless a specific definition is set forth at length herein.

Referring particularly to the drawings, there is illustrated a binder spine 10, which includes a back panel 12, a first side panel 14, a second side panel 16, a plurality of socket members of which 40 is typical, and a plurality of post members of which 38 is typical. A first panel mounting edge 22 on first side panel 14 is joined through a living hinge to a first longitudinal edge 24 of back panel 12. A second panel mounting edge 20 on second side panel 16 is joined through a living hinge to a second longitudinal edge 18 of back panel 12. The respective side panels are foldable relative to back panel 12 along the respective living hinges so as to bring post member 38 into interengageable relationship with socket member 40. Forcing post member 38 into socket member 40 causes these members into releasable Interengagement, and releasably retains the binder spine 10 in a folded configuration. See, for example, FIG. 5. The periphery of spine 10 is bounded by generally opposed laterally extending edges 28 and 34, and generally opposed longitudinally extending edges 30 and 36. Three mating pairs of socket and post members, 48-50, 44-46, and 40-38 are illustrated, for example, in FIGS. 7 and 8.

The respective living hinges are formed in the obverse face of the binder spine by removing generally parallel grooves of material from the obverse face. See, for example, FIG. 12. The grooves do not penetrate entirely through the spine, so the reverse face 26 of spine 10 is plain and unbroken (FIG. 2).

The embodiments depicted particularly in FIGS. 1-5, 7, and 8 are configured to hold papers that, for example, are adapted to be mounted in a conventional 3-ring binder. Such papers typically have three spaced apart holes punched along one long side. The holes are positioned over the socket members and when the mating post members are engaged with the socket members, the papers are held in associated relationship with the binder spine.

It has been found advantageous to provide a system of binder spines wherein spines with different capacities are made. If only a few papers are to be held together, the capacity of the spine need not be much larger than is necessary to accommodate them. Where a larger group of papers is to be bound, a spine with a larger capacity is required. For reasons of economy and efficiency in production, storage, and transportation, and appeal in marketing and sales, it has been found desirable to provide a plurality of spines that are substantially identical in size and shape, except with differing capacities.

It has been found that a system of binder spines with different capacities but substantially similar shapes and sizes can be provided by maintaining substantially the same dimensions and proportions, changing only the widths of the back panels, the lengths of the socket members, and, possibly, although not necessarily, the lengths of the post members. For an illustration of one such system of binder spines, attention is invited to the system shown in, for example, FIGS. 9 through 12 where a three member system is illustrated. The binder spines are illustrated in the completely unfolded configuration. As will be understood by those skilled in the art, two member, four member, and other systems are possible, as may be desired. In FIGS. 9 through 11, three short binder spines, each of which has one mating pair of socket and post members, are illustrated. As will be understood by those skilled in the art, binder spines with two, four, or other socket-post member pairs can be provided, as may be desired. An end view of each of the binder spines in the system is illustrated in FIG. 12 with centerlines provided to illustrate the relationships between the members of the system. First binder spine 58 (FIG. 9) has a back panel 60 attached through living hinges to side panels. Post member 66 is mounted on one side panel, and socket member 62 is mounted on the other. The binder spine 58 is foldable along the respective living hinges to bring post and socket members 66 and 62, respectively, into alignment with one another. Upon the application of force in an engaging direction, the post member can be caused to enter the socket 64 of socket member 62. Once interengaged, the post and socket member will remain engaged until force is applied in a disengaging direction. As shown particularly in FIG. 12, the centerlines, 68 and 70 of the socket and post members remain spaced apart by substantially the same distance throughout the members of the system. The overall width of the binder spines remains substantially the same throughout the members of the system. The widths of the back panels between the living hinges, change from one member of the system to the next with back panel 54 of binder spine 42 being the narrowest, back panel 60 being the widest, and back panel 12 of binder spine 10 being intermediate the other two members of the system. This provides three different binder spines, 58, 10, and 42, in this system with three different capacities. The post members 56, 38, and 66 can be varied in length to closely match the socket in the respective mating socket members, but this is not necessary. The post members can all be the same length if desired. A post member, for example, that is short enough to properly interengage with socket member 52 will also serve to engage with socket 64 in longer socket member 62. Centerlines 72 and 74 are spaced apart by the width of back panel 60 in binder spine 58. The relative widths of back panels 12 and 54 to back panel 60 and one another are shown by the projection of the centerlines 72 and 74 through the binder spines 10 and 42.

The axial alignment of the post and socket members in the different spines, as illustrated in FIG. 12, permits the system to be formed using a single mold with adjustable elements to form the living hinges, the socket members, and, if desired, the post members. The savings in manufacturing costs are substantial. The maintaining of the same distance between the socket and post members in the various binder spines results in some change in the throat size from one member of the system to the next. The throat size is the distance between the adjacent surfaces of the socket member and the back panel in the fully closed configuration. The throat size must be sufficient to permit the edges of papers held by the binder spine to clear the surface of the back panel. As the back panel becomes smaller, the throat size increases. Compare, for example, the throat size of the embodiments of FIGS. 5 and 6. The distance between the post and socket members in the fully unfolded configuration should be such that the edge of the paper will clear the back panel in the largest capacity member of the system, that is in the embodiment with the smallest throat size.

The composition of binder spines according to the present invention is preferably the same throughout the binder spine. At least the post and socket members should be made of a material that facilitates the use of generally straight sided cylindrical walls in both the post and socket members. It has been found that it is not necessary to provide specially shaped members with enlarged heads and mating annular pockets or the like to achieve a secure interengagement that requires the application of carefully directed force to disengage. It has also been found that a definite snapping sound can be achieved when straight sided cylindrical walls are engaged with one another, and that such snapping sound is an indication that the proper conditions for holding the binder in the folded configuration have been achieved. When, for example, the post and socket are about the same diameter, and they are composed of a relatively rigid materials such as an organic polymer in the nature of high density polyethylene, polypropylene, or the like, the engagement or disengagement of the one with the other will cause a snapping sound as the air is compressed or expanded. The fit between, for example, the post member 66 and socket 64 must be sufficiently tight to form an airtight seal between the two when in the fully engaged configuration. The socket 64 has no opening except at the top where the post member enters it. The materials and methods of construction must be such as to permit the formation of the desired airtight seal while still allowing the parts to be interengaged. The choice of materials and the correct dimensions of the post member and socket that are required to achieve the desired snap fit are arrived at by an iterative process. A prospective material of construction is selected, and a binder spine is formed, generally, but not necessarily, by molding. If, upon testing by engaging and disengaging the post member in the socket, it is found that no sound is produced, the test unit is examined to determine whether an airtight seal is being achieved. If no such seal is being formed, the diameter of one or both of the cylindrical walls is adjusted to make a tighter fit. If the diameter can not be so adjusted without preventing the parts from interengaging, the material of construction is changed, and the process repeated. When an audible snap is heard upon both engagement and disengagement, a suitable combination of materials and dimensions has been found. The airtight seal holds the socket and post member engaged. Air pressure holds them together. A vacuum is created when they are pulled apart. When they disengage the air rushing in to fill the void causes the audible snap. When they engage the compressed air rushing out causes a snap. Either way, the existence of the desired "snap fit" is detected by the audible snap. No particular shaping of the ends of the socket or post member is necessary to facilitate engagement of one with the other. Plain squared off ends will engage perfectly well.

The sound of the snap allows the user to know that the spine has been closed properly, and can be expected to reliably perform its intended function of holding papers. Likewise, the snap tells the user that the spine has been opened, and will release its contents.

Binder spines according to the present invention are intended to provide a way of hold a group of related papers together while still allowing maximum access to the at a reasonable cost. Typically, in a system of binders that provide different capacities the widths of the back panels vary from one another by at least about one-tenth, and preferably by at least about one-eighth of an inch. Variations of up to about three-eighths of an inch or more are useful. In general, the range of the widths of the back panels in one system of binders is no more than approximately one-half inch. With greater ranges of back panel widths, the throat depths in the smallest capacity members of the system become excessive. The width of the back panel in a binder spine is generally no less than approximately 5, and preferably 10 percent of the overall width of the binder spine in the fully open configuration. Generally, the side panels will be of approximately the same length, although they can be different if desired.

In a preferred embodiment of the binder spines and system of binder spines, the binder spines are intended for use in holding papers that have been perforated along one long side for insertion in a conventional three-ring binder. The binder spines overall are about eleven and one-eighth inches long, and two and three-eighths inches wide. The back panels of the three individual members of the system are one-eighth, three-eighth, and one-half inches wide between the centers of the fold lines of the living hinges, respectively. The post and socket members in each binder spine are spaced apart laterally center-to center in the fully open configuration by about one and one-half inches. The three pairs of post and socket members are spaced longitudinally center-to-center from one another by about four and one-quarter inches with the center pair being spaced equa-distant from the ends of the binder spines. The socket members are generally straight sided and cylindrical with an outside diameter of about one-quarter inch, and an inside diameter of about 0.150 inches. The post members are generally straight sided and cylindrical with an outside diameter of about 0.155 inches. The socket member in the embodiment with the one-half inch wide spine has a height of about 0.525 inches, and the mating post member has a height of about 0.220 inches. The socket member in the embodiment with the three-eighth inch wide spine has a height of about 0.260 inches, and the mating post member has a height of about 0.170 inches. The socket member in the embodiment with the one-quarter inch wide spine has a height of about 0.135 inches, and the mating post member has a height of about 0.120 inches. The outer ends of the post members are substantially squared off. The outer ends of the socket members are likewise substantially squared off so there is no need for chamfering or filleting either the mouth of the socket member or the entry end of the post member. An audible snap is heard when a mating pair of post-socket members is engaged, and when it is disengaged. While not wishing to be bound by any theory, it is believed that the squaring off of the initial engagement elements contributes to the emission of or at least the loudness of the audible snap. The binder spins are composed of polyproplyene.

What have been described are preferred embodiments in which modifications and changes may be made without departing from the spirit and scope of the accompanying claims. Many modifications and variations of the present invention are possible in light of the above teachings. It is therefore to be understood that, within the scope of the appended claims, the invention may be practiced otherwise than as specifically described.

What is claimed is:

1. A system of binder spines comprising:

a first binder spine;

a second binder spine;

at least a third binder spine, each of said binder spines including a back panel, said back panel being generally rectangular, having a width and a length and bounded by generally opposed longitudinal edges and generally opposed lateral edges, a first of said longitudinal edges being joined through a first living hinge to a first side panel mounting edge of a first side panel and a second of said longitudinal edges being joined through a second living hinge to a second side panel mounting edge of a second side panel, each of said binder spines being foldable along said living hinges between an open generally flat configuration and a generally closed configuration, a plurality of post members located on said first side panel and a plurality of socket members located on said second side panel, said socket and post members including mating walls and being spaced apart in said open generally flat configuration by a distance, said mating walls being generally straight sided cylinders throughout their lengths, said socket and post members being positioned to retainingly interengage one another in said generally closed configuration to hold said binder spine in said generally closed configuration, said socket members being closed except for an opening at the top, each said opening being adapted to receiving a said post member in a snap fit wherein said post and socket members are adapted to forming airtight seals with one another when interengaged, the back panel in said second binder spine being at least about one-tenth of an inch wider than the back panel in said first binder spine, and the back panel in said third binder spine being at least about one-tenth of an inch wider than the back panel in said second binder spine, said distance between said socket members and post members being substantially the same in each of said first, second, and third binder spines.

2. A system of binder spines according to claim 1, wherein the back panel in said second binder spine being at least about one-eighth of an inch wider than the back panel in said first binder spine, and the back panel in said third binder spine being at least about one-eighth of an inch wider than the back panel in said second binder spine.

3. A system of binder spines according to claim 1, wherein each of said binder spines includes at least three of said socket and post members.

4. A system of binder spines according to claim 1, wherein each of said binder spines has a binder width in an open configuration, the width of said back panel being at least about 5 percent of said binder width.

5. A system of binder spines according to claim 1, wherein each of said binder spines has a binder width in an open configuration, the width of said back panel being at least about 10 percent of said binder width.

6. A binder spine comprising:

a back panel, said back panel being generally rectangular, having a width and a length and bounded by generally opposed longitudinal edges and generally opposed lateral edges, a first of said longitudinal edges being joined through a first living hinge to a first panel mounting edge of a first side panel and a second of said longitudinal edges being joined through a second living hinge to a second side panel mounting edge of a second side panel, said binder spine being foldable along said living hinges between an open generally flat configuration and a generally closed configuration, at least one post member located on said first side panel and at least one socket member located on said second side panel, said socket and post members including mating walls and being spaced apart in said open generally flat configuration by a distance, said mating walls being generally straight sided cylinders throughout their lengths, said socket members being closed except for an opening at the top, said socket and post members being positioned to retainingly interengage one another in said generally closed configuration to hold said binder spine in said generally closed configuration, said openings being adapted to receiving said post member in a snap fit wherein said post and socket members are adapted to forming airtight seals with one another when interengaged.

7. A binder spine according to claim 6, wherein said binder spine includes at least three of said socket and post members.

8. A binder spine according to claim 6, wherein each of said binder spines has a binder width in an open configuration, the width of said back panel being at least about 5 percent of said binder width.

9. A binder spine according to claim 6, wherein each of said binder spines has a binder width in an open configuration, the width of said back panel being at least about 10 percent of said binder width.

* * * * *